United States Patent [19]

Wiegers et al.

[11] 4,165,301

[45] Aug. 21, 1979

[54] USES OF TERPENE DIMERS IN PERFUMERY PROCESSES AND PRODUCTS

[75] Inventors: Wilhelmus J. Wiegers, Red Bank; John B. Hall, Rumson; Ira D. Hill, Locust; Robert M. Novak, Fords; Frederick L. Schmitt; Braja D. Mookherjee, both of Holmdel; Chi-Kuen Shu, Cliffwood; William L. Schreiber, Jackson, all of N.J.

[73] Assignee: International Flavors & Fragrances Inc., New York, N.Y.

[21] Appl. No.: 902,436

[22] Filed: May 3, 1978

[51] Int. Cl.[2] ..... C11B 9/00

[52] U.S. Cl. ..... 252/522; 252/108; 252/122; 252/132

[58] Field of Search ..... 252/522, 108, 122, 132

[56] References Cited

U.S. PATENT DOCUMENTS

| | | | |
|---|---|---|---|
| 2,249,112 | 7/1941 | Carmody | 260/666 R |
| 2,422,145 | 6/1947 | Taylor | 252/522 |
| 3,415,893 | 12/1968 | Sellers et al. | 568/820 |
| 3,673,120 | 6/1972 | James et al. | 252/522 |

FOREIGN PATENT DOCUMENTS 7392355 11/1973 Japan .

OTHER PUBLICATIONS

Chem. Ab. 45:5880h, 1951.

*Primary Examiner*—Veronica O'Keefe
*Attorney, Agent, or Firm*—Arthur L. Liberman; Franklin D. Wolffe

[57] ABSTRACT

A process is described for providing clear extended compositions of synthetic and/or natural essential oils and/or perfumery chemicals which comprises admixing a composition of a synthetic and/or natural essential oil and/or perfumery chemical and an extender material miscible with said synthetic and/or natural essential oil and/or perfumery chemical which does not appreciably alter the aroma of the synthetic and/or natural essential oil and/or perfumery chemical insofar as its quality or strength is concerned, the proportion of synthetic and/or natural essential oil and/or perfumery chemical in extender material being from about 70% up to about 99%, said extender material being one or more "dimerization" (or "coupling") products of one or more terpenes which are monocyclic and have two carbon-carbon double bonds or which are bicyclic and have one carbon-carbon double bond or one or more hydrogenated derivatives thereof or mixtures of same.

10 Claims, 7 Drawing Figures

GLC PROFILE FOR EXAMPLE IA

GLC PROFILE FOR EXAMPLE IA

I R SPECTRUM FOR EXAMPLE I A

GLC PROFILE FOR EXAMPLE IC

I R SPECTRUM FOR EXAMPLE IC

USES OF TERPENE DIMERS IN PERFUMERY PROCESSES AND PRODUCTS

BACKGROUND OF THE INVENTION

Compounded perfumery compositions contain a number of ingredients which may be of natural of synthetic origin. The ingredients are blended by the perfumer to create the desired odor effect. Such essential oils which contain high percentages of hydrocarbon constituents such as patchouli oil (an essential oil derived from Pogostemon Patchouli) have, for example, warm aromatic spicy odors. When the perfumer wishes to include this type of note for example in a perfumery composition of an oriental type, he will use patchouli oil. However, such natural oils as oil of patchouli are expensive essential oils and are of limited availability. Even more extreme examples are natural sandalwood oil and natural vetiver oil. Although, attempts have been made to simulate the odor of patchouli oil, sandalwood oil, and vetiver oil by use of blends of synthetic perfumery chemicals, the creation of such oils having identical aromas with reference to the natural oils has not been achieved.

In U.S. Pat. No. 3,673,120 issued on June 27, 1972, 8-camphene carbinol was indicated to be useful as a perfumery extender for patchouli oil in perfumery compositions when present in a concentration of from 1 to 200 parts by weight per 100 parts by weight of the patchouli oil. However, 8-camphene carbinol has the disadvantage of significantly decreasing the aroma strength of the patchouli oil and is not versatile for use with oils other than patchouli oil, for example, vetiver oil and sandalwood oil in the genus of natural oils, and synthetic oils, for example, geranonitrile and cinnamonitrile.

In U.S. Pat. No. 2,422,145 issued on June 10, 1947, water-soluble hydroxy polyoxyethylene ethers of partial higher fatty acid esters of low molecular weight polyhydroxylic compounds were found to form clear extended solutions with essential oils which could be used as such or which could be diluted with water to form stable dispersions or solutions of essential oils. Specifically disclosed are compositions containing clear, stable solutions of a quantity of an essential oil and at least an equal quantity of such ethers as mannitan monopalmitate hydroxy polyoxyethylene ether with about 20 oxyethylene units per mole with such solution being capable, upon dilution with water, of forming a clear, stable aqueous dispersion of essential oil and hydroxy polyoxyethylene ether. U.S. Pat. No. 2,422,145, however, does not disclose the formation of solutions of essential oil in organic solvents which are immiscible with water. Furthermore, the ether of U.S. Pat. No. 2,422,145 significantly reduce the strength of the perfumery material when used in conjunction with same.

Cyclohexane dicarboxylic acid diesters having the structure:

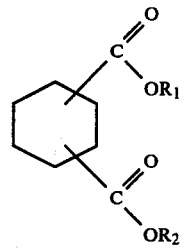

where $R_1$ and $R_2$ are less than 13 carbon aliphatic or alicyclic hydrocarbon moieties are disclosed to be useful "perfume harmonizing agents" in Japanese Published Application at No. J 52,136,927 issued on Nov. 15, 1977 to Asahi Denka Kogyo. However, such materials as these cyclohexane dicarboxylic acid diesters detract from the strength of the perfume material with which it is used.

In U.S. Pat. No. 3,415,893 issued on Dec. 10, 1968, synthetic pine oil, a material well known to be useful in the perfumery arts was indicated to be synthesized in such a manner that alpha pinene and aqueous sulfuric acid containing emulsifier were agitated under controlled temperature conditions until the content of terpene alcohols reached a maximum. The oil and aqueous phases, in U.S. Pat. No. 3,415,893, are then separated and the oil phase is washed with water containing basic materials to neutralize any residual acid. The oil phase is then distilled to separate the pine oil product from "unreacted alpha pinene and other terpenes, if present as well as from the by-products of the reaction". It is indicated that the by-products are primarily monocyclic hydrocarbons containing some cineols, cyclic ethers and other undesirable products of the reaction and that the by-product portion is a useful solvent. Nothing in U.S. Pat. No. 3,415,893 discloses the usefulness of the diterpenes of our invention and the advantages thereof as extenders in perfumery.

Diterpenes and hydrogenated diterpenes resulting from the action of various acids on monoterpenes have been studied by various investigators since the discovery over a century ago of dipinene by Deville, Ann. Chim. Phys. [2] 75, 66 (1840) and Ann. Chim. 37, 192 (1840) who obtained dipinene from terpentine oil and sulfuric acid. These experiments of Deville were reviewed as was the literature of synthetic dipinenes in general, by Dulou, Chimie et Industrie, 27 (Special Number) 651 (1932) wherein compounds having the structures of dipinene, indicated to be:

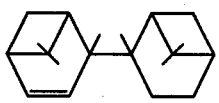

and

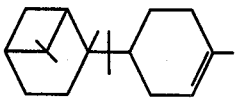

were stated to be produced from alpha pinene having the structure:

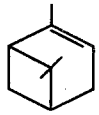

Di-alpha pinene was also produced by Kuwata, J. Faculty Eng. Tokyo Imp. Univ. 18 117–24 (1929) by the action of Japanese acid clay on d-alpha-pinene. In a two-stage reaction, venable, J. Am. Chem. Soc. 45, 728–34 (1923) treated alpha pinene with fillers earth causing it first to undergo a molecular rearrangement and then causing a subsequent polymerization to dipinene. Kuwata, in J. Soc. Chem. Ind. Japan 36, Suppl. binding 256–8 (1933) [abstracted in Chem. Abstracts 27:3927] discloses the treatment of camphene in a benzene solution with Japanese acid clay yielding dimer. Camphene dimers are also disclosed to be produced in Japanese Kokai 73 92,355 of Nov. 30, 1973 wherein camphene is passed through a strongly acidic cation exchange resin at one atmosphere and in vacuo at less than or equal to 130° C. to produce camphene dimers and trimers. Japanese Kokai No. 73 92,355 (Patent Application No. 27686/72) contains the following claims:

"The process to manufacture oligomers of camphene by the polymerization of camphene at less than 130° C. and under atmospheric or reduced pressure with the catalysts of ion exchange resin of strong acid type."

In addition, Japanese Kokai 73 92,355 also contains the following relevant disclosure:

"By this invention, the produced oligomers are removed from the reaction system, therefore eliminating the chances of side reactions such as isomerization, hydrolysis, dehydration and oxidation. The products can be obtained in high yield without tetramer or higher oligomers, and are colorless and odorless which are suitable for use in fragrances, cosmetrics and food additives."

The specific properties of the camphene dimers and their utility in the manner described herein as perfumery extenders and diluents are not disclosed in Japanese Kokai 73, 92,355, however.

The dimer of limonene is indicated to be prepared from d-limonene by Beilstein V. 509, page 246 (No. 9). The presence of the dimer of limonene is indicated to exist in the essence of Dictamnus Hispanicus in Chem. Abstracts 45:5880 [abstract of "The Essence of Dictamnus Hispanicus", J. Sistare (Inst. 'Alonso Barba' Barcelona, Stain) Anales Real Soc. Espan. Fis. Ey. Quim. 47 B, 171–4 (1951)].

In U.S. Pat. No. 2,249,112 issued on July 15, 1941, hydrogenated pinene polymers are indicated to be useful for their "solubility-viscosity characteristics", making them usable as impregnants, adhesive materials, and as a vehicle for metallic paints. They are also indicated to be compatible with many mineral oils and can be blended with rubber to produce soft tacky compositions. The hydrogenated pinene polymers indicated to be so produced in U.S. Pat. No. 2,249,112 are produced according to the following reaction scheme:

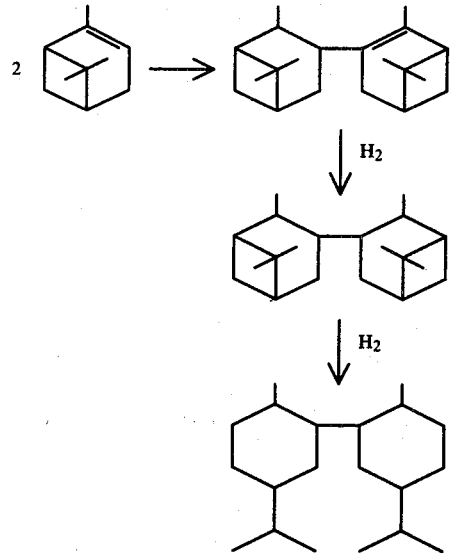

and stated to take the structures:

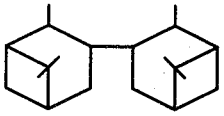

and

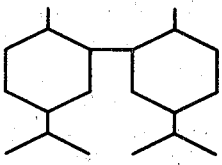

The hydrogenated terpene polymers of U.S. Pat. No. 2,249,112 are not taught to be useful as perfume extenders and are not indicated to have the properties in conjunction with certain perfume essential oils as is disclosed and claimed in the instant application.

Perfume extenders have been broadly used as "adulterants" in the art of perfumery. Thus, for example, in the text entitled "The Art of Perfumery and Method of Obtaining the Odors of Plants" authored by piesse (Lindsay and Blakiston, Publishers, Philadelphia, 1856) turpentine and spike oil are indicated to be adulterants for lavender oil on page 255. In Poucher "Perfumes and Cosmetics" Van Nostrand Company 1923 terpene residues obtained during the manufacture of concentrated lemon oil are indicated to be adulterants for lemon oil. In Vol. 1 of "The Essential Oils", Guenther, Krieger Publishing Company 1975, Vol. 1 Terpinyl Acetate, and Turpentine Oil (containing d-alpha pinene) are indicated to be used as adulterants. In Vol. 2 of "The Essential Oils" camphorene, a "diterpene" indicated to be widely applied as fixatives in the sending of soaps. Alpha camphorene has the structure:

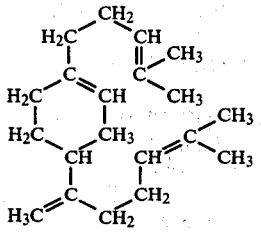

However, there is no suggestion in the prior art that the dimerization products and/or hydrogenated derivatives thereof of our invention are useful in the manner described herein as perfumery extenders and diluents.

THE INVENTION

Figure 1:
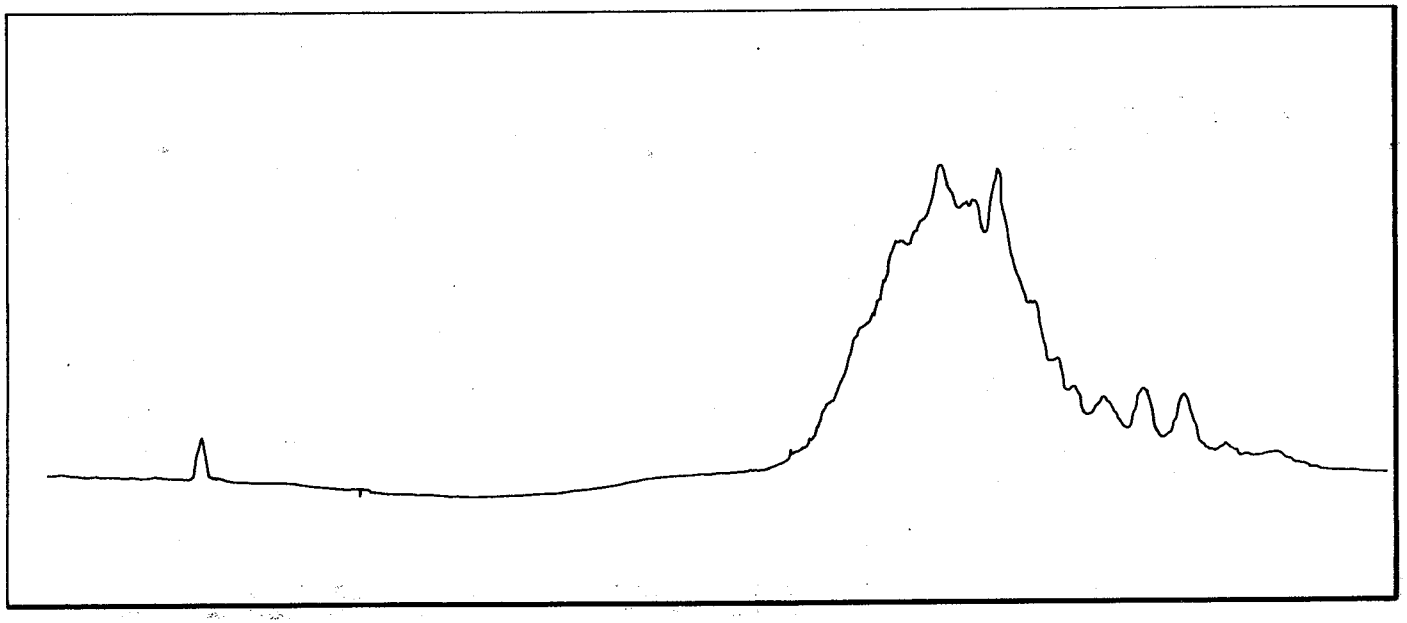
FIG. 1 is the GLC profile for the dimerization product of alpha-pinene produced according to Example 1 (A).

Surprisingly, it has been found that dimerization products of (i) monocyclic terpenes containing two carbon-carbon double bonds, (ii) bicyclic terpenes containing one carbon-carbon double bond and (iii) a monocyclic terpene containing two carbon-carbon double bonds and a bicyclic terpene containing one carbon-carbon double bond or mixtures of same or hydrogenation products thereof or mixtures of said hydrogenation products and said dimerization products may be used as diluents or extenders of various perfumery materials without appreciable loss of the characteristic odor effect of such perfumery materials.

Such dimerization products are produced by dimerizing such compounds as camphene having the structure:

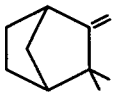

or alpha pinene having the structure:

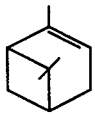

or d-limonene having the structure:

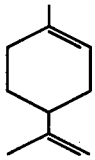

or alpha phellandrene having the structure:

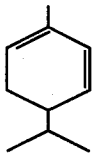

or gamma-terpinene having the structure:

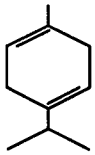

or delta $^3$-carene having the structure:

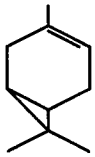

or beta phellandrene having the structure:

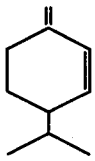

or beta-terpinene having the structure:

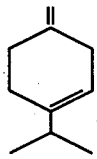

or alpha terpinene having the structure:

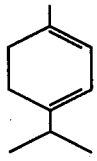

or terpinolene having the structure:

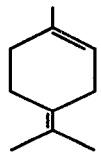

or beta pinene having the structure:

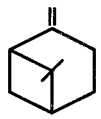

or by "dimerizing" mixture of two or more of such compounds, such as the mixture of $C_{10}$ terpenes commonly known as "sulfate turpentine" or by "dimerizing" a $C_{10}$ terpene and a dehydrogenated terpene (e.g., cymene) in the presence of acid catalysts, such as sulfuric acid and hydrofluoric acid or in the presence of acid clay catalysts, such as Japanese Acid Clay or Fullers earth or acidic cation exchange resin catalysts. The said "dimerization" products are compounds having such possible structures as:

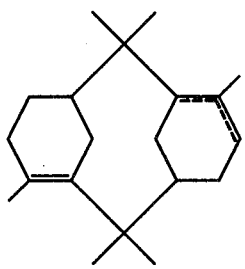

and the hydrogenation products thereof have such possible structures as:

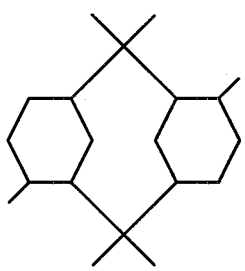

The terms "dimerization product" and "dimer" are intended to cover reaction products containing 20 carbon atoms resulting from the reaction of a 10 carbon atom terpene compound (monocyclic with two double bonds or bicyclic with one carbon-carbon double bond) with itself or with another terpene compound which is monocyclic or bicyclic, without regard to the number of hydrogen atoms contained in any molecules of said reaction products.

"Turpentines" including "sulfate turpentine", a by-product of the Kraft (sulfate) pulping process for producing paper are described in a paper by John M. Derfer, entitled "Turpentine as a Source of Perfume and Flavor Materials", *Perfumer and Flavorist International*, Vol. 3, No. 1 at pages 45–50. The composition of the "turpentines" including the above-mentioned "sulfate turpentines" are described therein as follows:

"In all three types of turpentine produced in the southern United States (which is the world's largest producing region), alpha pinene is the most abundant constituent, varying from 60% to 80% (see Table I). Beta pinene is the second most abundant constituent in gum and sulfate turpentine, varying from 25% to 35% in the former, and 20% to 25% in the latter. Wood turpentine contains little, if any, beta pinene. Of the two pinenes, beta pinene is the most versatile chemically. Gum terpentine contains 5% to 8% of monocyclic p-menthadienes, commonly referred to as "dipentene", the trivial name for dl-limonene, Table I

| Composition of Southern Turpentines (%) | | | |
|---|---|---|---|
| Component | Sulfate | Gum | Wood |
| Alpha Pinene | 60–70 | 60–65 | 75–80 |
| Beta Pinene | 20–25 | 25–35 | 0–2 |
| Camphene | Trace | Trace | 4–8 |
| Others | 6–12 | 5–8 | 15–20 |

which is the chief component of this p-menthadiene mixture. Sulfate turpentine contains 6% to 12% of this mixture, while wood turpentine contains somewhat more. Sulfate turpentine contains 5% to 10% of oxygenated material from which "natural" pine oil, mostly terpene alcohols, is separated. "Natural" pine oil is also produced in the processing of stumpwood to produce wood turpentine. Caryophyllene, methylchavicol, and anethole also occur in small amounts in sulfate turpentine. The composition of turpentine depends not only on the method of isolation, but also on the species and the geographic location of the trees. For example, some western turpentines, as well as certain foreign turpentines, contain appreciable amounts of 3-carene, which finds little other use than as a solvent".

Accordingly, and more specifically, the species of turpentines useful in the practice of our invention, the ten carbon containing terpene ingredients of which are capable of being dimerized to form the dimerization products useful in our invention are as follows:

| Species of Pine from which Turpentine is Derived | | Chemical Composition of Turpentine |
|---|---|---|
| (1) | *Pinus albicaulis* Engelmann (White-bark pine) | $\Delta^3$-Carene (35%)<br>Other Terpenes (10%)<br>A Sesquiterpene (7%)<br>A Diterpene (30%) |
| (2) | *Pinus Aristata* Engelmann (Bristle-cone pine) | dl-and l-α-Pinene (96%)<br>A Tricyclic Sesquiterpene (4%) |
| (3) | *Pinus attenuata* Lemmon (Knobcone pine) | Over 95% d-α-Pinene<br>No β-Pinene or Camphene |
| (4) | *Pinus balfouriana* Grev. and Balf. (Foxtail pine) | dl-and l-α-Pinene (90%)<br>dl-and l-β-Pinene (2%)<br>dl- and l-Limonene (2%)<br>A Tricyclic Sesquiterpene (4%) |
| (5) | *Pinus banksiana* Lambert (Jack pine) | dl- and l-α-Pinene (85%)<br>dl- and l-β-Pinene (10%) |
| (6) | *Pinus caribaea* Morelet (Slash pine) | l-α-Pinene (61.5%)<br>l-β-Pinene (34%)<br>Tailings (4.5%) |

-continued

| Species of Pine from which Turpentine is Derived | | Chemical Composition of Turpentine |
|---|---|---|
| (7) | *Pinus clausa* (Engelmann Vasey (Sand pine) | 1-α-Pinene (10%)<br>1-Camphene (10%)<br>1-β-Pinene (75%) |
| (8) | *Pinus contorta* var. Latifolia Engelmann (Lodgepole pine) | 1-β-Phellandrene |
| (9) | *Pinus coulteri* (D. Don (Coulter pine) | n-Heptane (5%)<br>1-β-Pinene (30%-35%)<br>1-β-Phellandrene (35%-45%)<br>n-Undecane (10%) |
| (10) | *Pinus echinata* Miller (Shortleaf pine) | d-α-Pinene (85%)<br>1-β-Pinene (11%)<br>Limonene |
| (11) | *Pinus edulis* Engelmann (Pinyon, Colorado pinyon pine) | α-Pinene (70%-75%)<br>β-Pinene (5%)<br>α-Cadinene (15%-20%) |
| (12) | *Pinus flexilis* James (Limber pine) | dl- and 1-α-Pinene (80%)<br>Albicaulene-A Monocyclic Sesquiterpene (13%)<br>Bicyclic Sesquiterpene (7%) |
| (13) | *Pinus glabra* Walter (Spruce pine) | 1-Limonene |
| (14) | *Pinus lambertiana* Douglas (Sugar pine) | 1-α-Pinene (65%)<br>1-β-Pinene (13%)<br>Bicyclic Sesquiterpene of Cadalene Type (10%)<br>Lambertol (Sesquiterpene Alcohol $C_{15}H_{26}O$) (2%) |
| (15) | *Pinus monophylla* Torrey and Fremont (Single-leaf pinyon) | d-α-Pinene (85%)<br>1-Limonene or Dipentene (4%-5%)<br>d-Cadinene (4%-6%) |
| (16) | *Pinus monticola* Douglas (Wester white pine) | d-α-Pinene (60%)<br>β-Pinene (26%)<br>n-(Undecane (1%-2%)<br>Sesquiterpenes and perhaps Limonene |
| (17) | *Pinus muricata* D. Don (Bishop pine) | d-α-Pinene (98%-99%)<br>Camphene (less than 1%) |
| (18) | *Pinus palustris* Miller (Longleaf pine) | d-α-Pinene (65%)<br>1-β-Pinene (31.5%)<br>Tailings (3%) |
| (19) | *Pinus ponderosa* Lawson (Ponderosa pine) | 1-β-Pinene (50%)<br>1-$\Delta^3$-Carene (20%)<br>1-Limonene and Dipentene (25%)<br>d-Cadinene (3%)<br>Ponderene (less than 1%) |
| (20) | *Pinus ponderosa* var. scopulorum Engelmann (Rocky Mountain ponderosa pine) | 3-α-Pinene (60%-70%)<br>β-Pinene (5%)<br>Limonene (20%-25%) |
| (21) | *Pinus radiata* D. Don (Monterey pine) | dl-α-Pinene (75%)<br>1-β-Pinene (22%) |
| (22) | *Pinus resinosa* Ait. (Red pine) (Norway pine) | α-Pinene |
| (23) | *Pinus rigida* var. serotina (Michaux Loudon (Pond pine) | Limonene |
| (24) | *Pinus strobus* Linnaeus (Eastern white pine) | dl-α-Pinene (75%)<br>1-β-Pinene (15%)<br>Terpene Alcohols and Ketones (4%)<br>A Tricyclic Sesquiterpene (0.3%) |
| (25) | *Pinus taeda* Linnaeus (Loblolly pine) | d-α-Pinene (85%)<br>1-β-Pinene (12%) |
| (26) | *Pinus torreyana* Parry (Torrey pine) | 1-Limonene (75%)<br>n-Decylaldehyde (10%)<br>n-Undecane (5%)<br>Longifolene (4%)<br>Laurylaldehyde (0.2%) |

-continued

| Species of Pine from which Turpentine is Derived | | Chemical Composition of Turpentine |
|---|---|---|
| | | Heptane and Nonane (less than 0.1% of each) |
| (27) | *Pinus virginiana* Miller (Virginia pine) | dl-α-Pinene (90%)<br>1-α-Pinene (8%) |
| (28) | *Pinus washoensis* Mason and Stockwell | d-$\Delta^3$-Carene (chiefly), α-Pinene, Dipentene, A Cyclic Sesquiterpene, 1-β-Pinene (if $\Delta^3$-Carene content is low) |

A significant property of the above-said dimerization products and hydrogenated dimerization products or mixtures thereof is that they have a broad range of solubilities for various types of perfumery materials including complete solubility for certain alcohols, esters, pyrans, aldehydes, ketones, cyclic ethers, cyclic amines, nitriles and natural oils. Thus, for example, the following materials are completely miscible with the dimers which are the subject of our invention:

Phenyl Ethyl Alcohol
Geraniol
Terpineol
Citronellyl Acetate
Decyl Acetate
Rose Oxide
n-Decanal
Citral
Alpha Ionone
Eugenol
Galaxolide
2-Methyl-2-Pentenoic Acid
Isobutyl Quinoline
Lemon Oil
Rosemary Oil
Patchouli Oil
Cinnamonitrile
Geranonitrile Thus, it has been discovered that the dimers of our invention can be used as partial replacements for certain essential oils and synthetic substitutes therefor in compounded single phase liquid perfumery compositions.

Accordingly, the present invention comprises a compounded single phase liquid perfumery composition which comprises one or more synthetic perfume oils and/or natural perfume oils and/or perfume chemicals or mixtures thereof with which there has been incorporated from about 1 up to about 30 parts by weight of a dimerization product of (i) a monocyclic terpene containing two carbon-carbon double bonds or (ii) a bicyclic terpene containing one carbon-carbon double bond or (iii) a reaction product of a monocyclic terpene containing two carbon-carbon double bonds and a bicyclic terpene containing one carbon-carbon double bond and/or hydrogenated derivatives thereof per 100 parts of compounded single phase liquid perfumery composition. Specific examples of such dimerization products and hydrogenated derivatives thereof useful in the practice of our invention are:

Dimerization products of alpha pinene;
Dimerization products of beta pinene;
Dimerization products of camphene;
Dimerization products of d-limonene;
Dimerization products of gamma terpinene;
Dimerization products of alpha phellandrene;

Dimerization products of $\Delta^3$-carene;

Dimerization products of beta phellandrene;

Dimerization products of terpinolene;

Mixed dimerization products of alpha phellandrene and $\Delta^3$-carene wherein a mixture of the two is subjected to a dimerization reaction;

Mixed dimerization products of alpha phellandrene and gamma terpinene;

Mixed dimerization products of gamma terpinene and beta phellandrene;

Mixed dimerization products of alpha pinene, beta pinene and camphene;

Mixed dimerization products of alpha pinene and $\Delta^3$-carene;

Mixed dimerization products of sulfate terpentine;

Mixed dimerization products of terpinolene and gamma terpinene;

Hydrogenated derivatives of any of the foregoing or mixtures thereof

Each of these dimerization products and/or hydrogenated derivatives thereof taken alone or taken together, by themselves, contains no odor and each does not by itself impart any alteration of odor to any of the perfumery materials to which they are added. The above stated dimerization products, hydrogenated derivatives thereof and mixtures thereof may be produced according to any of the known methods in the prior art. Thus, a reaction scheme whereby a dimerization product may be produced useful in our invention and whereby hydrogenated derivatives thereof also useful in our invention are produced and whereby mixtures of such hydrogenated derivatives and dimerization products are produced is exemplified below:

Reaction Scheme:

2.

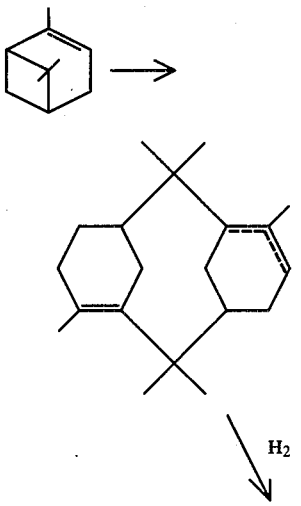

(possible structure; and many other isomers)

-continued

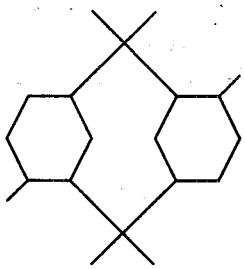

(possible structure; and many other isomers)

The catalysts useful in producing the dimerization products of ten carbon atom containing terpenes of our invention are Lewis acids such as borontrifluoride, aluminum trichloride, Bronstedt acids such as sulfuric acid and phosphoric acid, ion exchange resin catalysts such as Amberlyst 15, acid clays such as Fullers earth and Japanese Acid Clay. Such dimerization reactions will proceed in the presence of solvents such as cyclohexane, toluene and hexahydro-1,1,2,3,3-pentamethylindane or in the absence of solvents. The temperature of dimerization may vary from 20° C. up to 250° C. A preferred catalyst system with preferred temperature range are borontriflouride etherate at 0°-100° C. or Acid Clay at 80°-175° C. Atmospheric pressure may be used in the dimerization reaction although higher or lower pressures may also be used without adversely affecting the yield. The weight ratio of ten carbon atom containing terpene monomer:catalyst may vary from 1:0.005 up to 1:0.2 with a preferred weight ratio of 1:0.05 up to 1:0.01.

The extended perfumery oils and chemicals of our invention may be used in compositions where the natural oils or chemicals would have been used, for example, in combination with sandalwood oil, vetiver oil, oakmoss, ionone, labdanum, methyl ionene, patchouli oil and other synthetic substitutes therefor.

The extended perfumery materials of our invention will find use as constituents of compounded perfumery compositions in which a number of perfumery materials of natural and/or synthetic origin will be blended together to produce a particular desired odor effect. Such compositions may then be used in space sprays or can be blended in soap, detergent or deodorant compositions, including bath salts, shampoos, toilet waters, face creams, talcum powders, body lotions, sun cream preparations and shave lotions and creams. The perfumery compositions can also be used to perfume sub-straights such as fibers, fabrics and paper products.

The hydrogenated dimers of our invention may be prepared according to the same processes as set forth on page 2 of U.S. Pat. No. 2,249,112 issued on July 15, 1941. Any of the hydrogenated dimers produced according to U.S. Pat. No. 2,249,112 may be used in the practice of our invention.

The following examples are given to illustrate embodiments of the invention as it is presently preferred to practice it. It will be understood that these examples are illustrative and the invention is not to be considered as restricted thereto except as indicated in the appended claims.

EXAMPLE I (A)

PREPARATION OF ALPHA PINENE DIMER

Reaction:

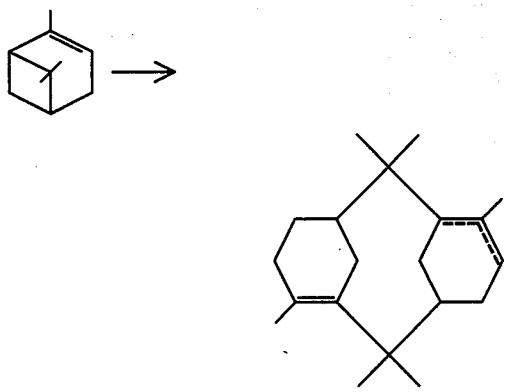

(possible structure; and many other isomers)

Into a two-liter reaction flask equipped with stirrer, thermometer, addition funnel and reflux condenser, are placed 100 g of alpha pinene and 40 g of Filtrol 25 (a 10–20 mesh granular acid activated clay produced by the Filtrol Corporation of 5959 West Century Boulevard, Los Angeles, Calif. 90045 having the following properties:

| Particle Size Analysis by Tyler Standard Sieve | | |
|---|---|---|
| Through 10 Mesh, Wt. % | 100 | |
| Through 20 Mesh, Wt. % | 5 | |
| Free Moisture, Wt. % | 10 | |
| Free and Combined Moisture, Wt. (Loss at 1700° F.) | 15 | (Max.) |
| Bulk Density, lbs./cu. ft. | 43.0 | |
| Particle Density | 1.3 | |
| Surface Area, $N_2$ adsorbent (Bet Method) $M^2$/gm | 280–300 | |

The reaction mass is heated to 150° C. with stirring and an additional 900 g of alpha pinene is added thereto over a period of two hours while maintaining the reaction mass at 150° C. The reaction mass is then continued to be stirred at 150° C. until GLC analysis of sampler shows that the reaction is complete (whereby little or no alpha pinene remains).

The reaction mass is then cooled to 80° C. and filtered using filter cell.

The filtrate is distilled at 3 mm Hg. vacuum using a 12 inch Goodloe column and starting at a 9:1 reflux ratio and then going to 4:1. Just prior to distillation, 30 g of Primol ® is added to the material to be distilled. The distillation data are as follows:

| Fraction | Vapor Temp. | Liquid Temp. | Vac. mm. | Reflux Ratio | Weight of Fraction |
|---|---|---|---|---|---|
| 1 | 35/75 | 72/115 | 50/35 | 9:1/9:1 | 44.1 |
| 2 | 39 | 95 | 3.0 | 9:1 | 53.9 |
| 3 | 41 | 103 | 3.0 | 9:1 | 46.0 |
| 4 | 41 | 165 | 3.0 | 4:1 | 68.7 |
| 5 | 31/128 | 152/158 | 1.0/.8 | 4:1/4:1 | 38.0 |
| 6 | 133 | 175 | 0.8 | 4:1 | 43.0 |
| 7 | 133 | 179 | 0.8 | 4:1 | 51.1 |
| 8 | 133 | 180 | 0.8 | 4:1 | 49.4 |
| 9 | 133 | 181 | 0.8 | 4:1 | 44.5 |
| 10 | 133 | 185 | 0.8 | 4:1 | 49.5 |
| 11 | 133 | 187 | 0.8 | 4:1 | 47.5 |
| 12 | 136 | 193 | 0.8 | 4:1 | 42.7 |
| 13 | 140 | 204 | 0.8 | 4:1 | 44.5 |

FIG. 1 is the GLC profile for the alpha pinene dimer (fractions 9–11). (Conditions: 2% Carbowax Column, 25'×¼" programmed at 80°–200° C. at 10° C. per minute).

Figure 3:
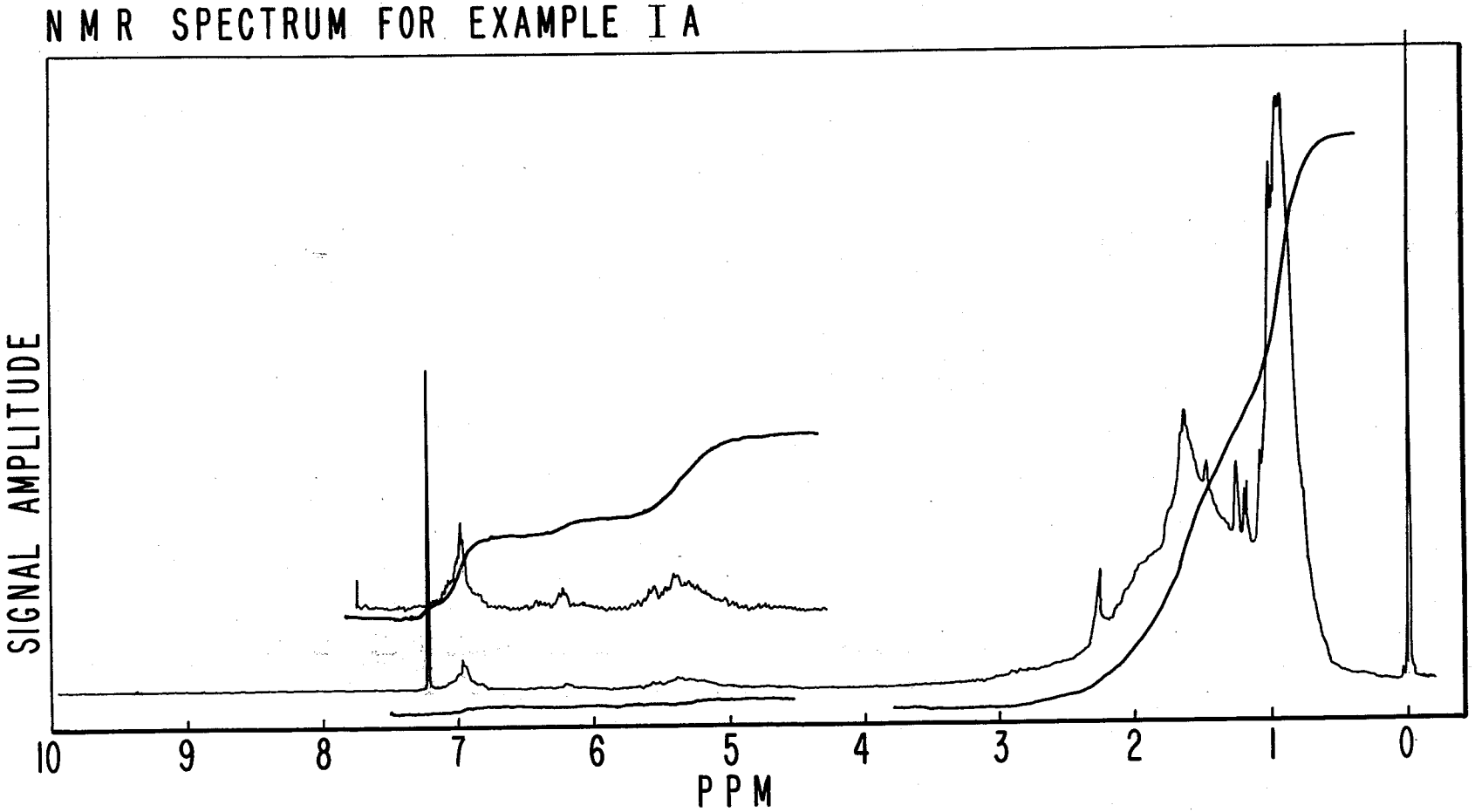
FIG. 3 is a NMR spectrum for the product produced according to Example I (A).
Figure 4:
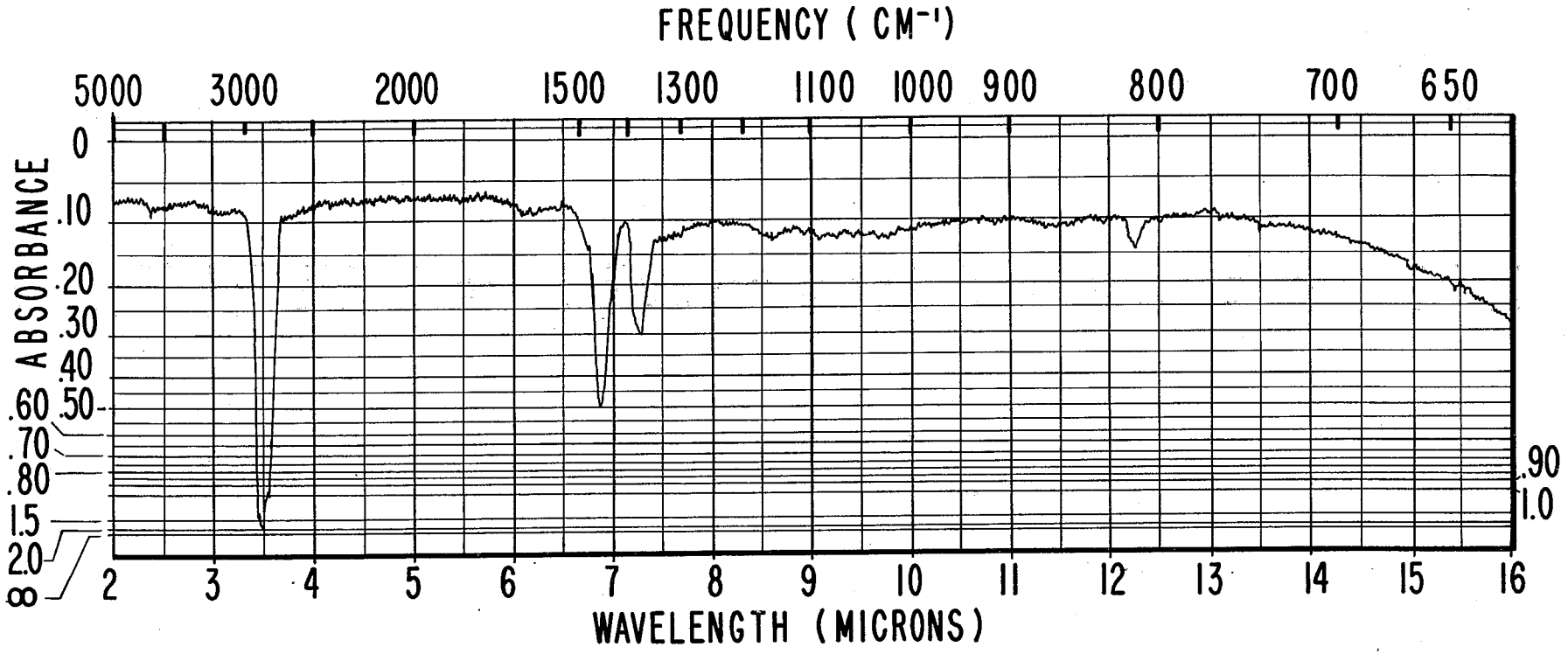
FIG. 4 is the infrared spectrum for the product produced according to Example I (A).

FIG. 3 is the NMR spectrum for the product of Example I (A). FIG. 4 is the IR spectrum for the product of Example I (A).

EXAMPLE I (B)

DIMERS OF CAMPHENE

Into a two-liter reaction flask equipped with stir, thermometer, addition funnel and reflux condenser with Bidwell Trap are placed:

| | |
|---|---|
| Hexahydropentamethylindane | 336 g |
| Filtrol 25 (Properties set forth in Example I (A) | 32 g |

with stirring the mixture is heated to 155° C. Over a period of 2.25 hours while maintaining the reaction mass at 155° C., 547 g of Camphene is added thereto. The reaction mass is then stirred for 7½ hours at 155°/158° C. and progress of dimerization is monitored on GLC apparatus (Conditions: 5% SE 30 column, 10'×¼", programmed at 80°–240° C. at 8° C. per minute). GLC analysis shows very little change after 2 hours. The reaction mass is then filtered. The filter cake is washed with 200 g of hexahydropentamethylindane. The weight of filtrate is 1056 grams. The resultant filtrate is distilled in the presence of Primol ® (30 g) and Ionox ® (1 g) through an 18" Vigreux column equipped with reflux head. The following distillation data is obtained:

| Fraction NO. | Vapor Temp. C. | Pot Temp. °C. | Pressure mm Hg. | Weight of Fraction (Grams) | GLC Analysis of Fraction |
|---|---|---|---|---|---|
| 1–6 | 45–100 | 87–160 | 2.6 | 631.9 | Recovered hexahydropentamethylindane |
| 7 | 149 | 170 | 3.5 | 10.5 | Intermediate Section |
| 8 | 150 | 170 | 2.8 | 40.7 | Practically Pure Dimers |
| 9–11 | 152–168 | 176–230 | 2.5 | 214.8 | Pure Dimers |
| 12 | 215 | 275 | 2.5 | 22.9 | |
| 13–14 | 225–250 | 290–306 | 2.5 | 62.7 | Very Little Eluted on GLC |
| | | | Residue - | 41.7 | |
| | | | Trap - | 18.0 | |

Figure 2:
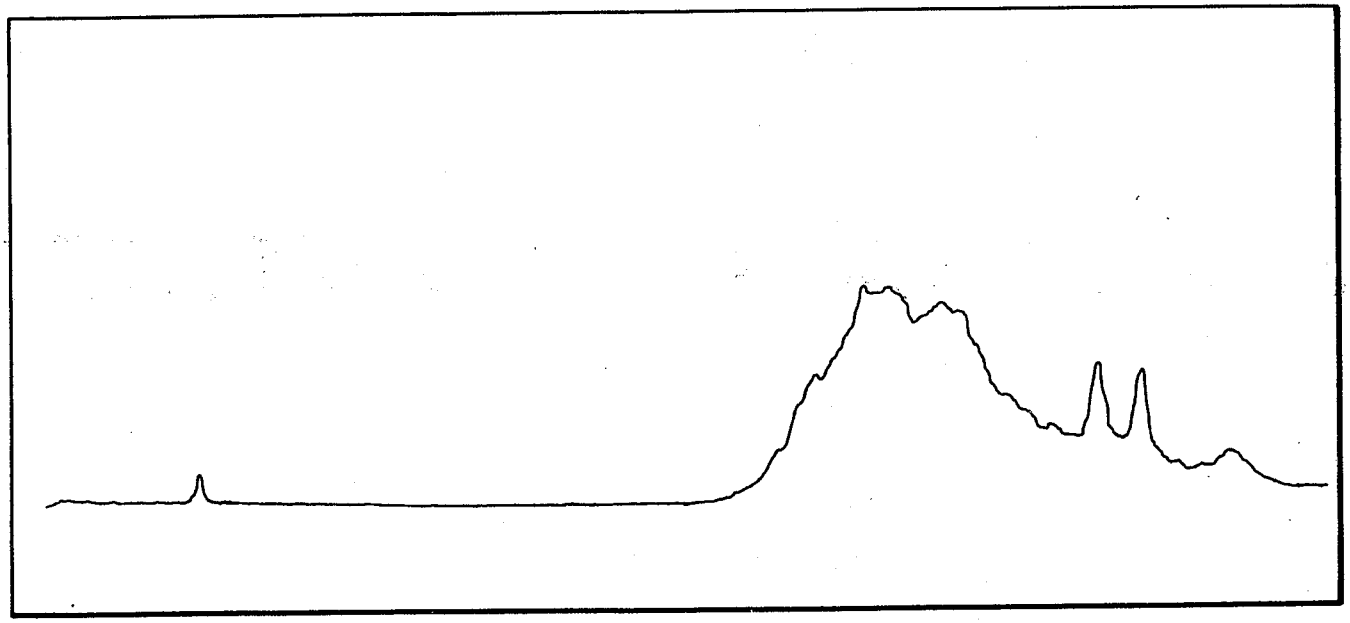
FIG. 2 is the GLC profile for the dimerization product of camphene produced according to Example I (B).

FIG. 2 sets forth the GLC profile for fractions 9–11, the camphene dimer (Conditions: 5% SE 30 column, 10′×¼″, programmed at 80°–240° C. at 8° C. per minute).

The structure of the hexahydropentamethylindane, used as a solvent is as follows:

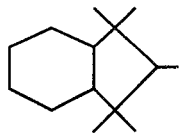

EXAMPLE I (C)

PREPARATION OF D-LIMONENE DIMER

Into a 500 ml reaction flask equipped with thermometer, stirrer, condenser and addition funnel are placed 5 g Primol® and 2 g Filtrol 25. The reaction mixture is heated to 150° C. and 40 g of limonene is added dropwise over a period of 80 minutes. The reaction mass is then heated at 150° C. for 3 hours.

The reaction mass is then cooled, filtered and distilled. The resulting product is the dimer of d-limonene, confirmed by GLC, NMR and IR analyses.

Figure 5:
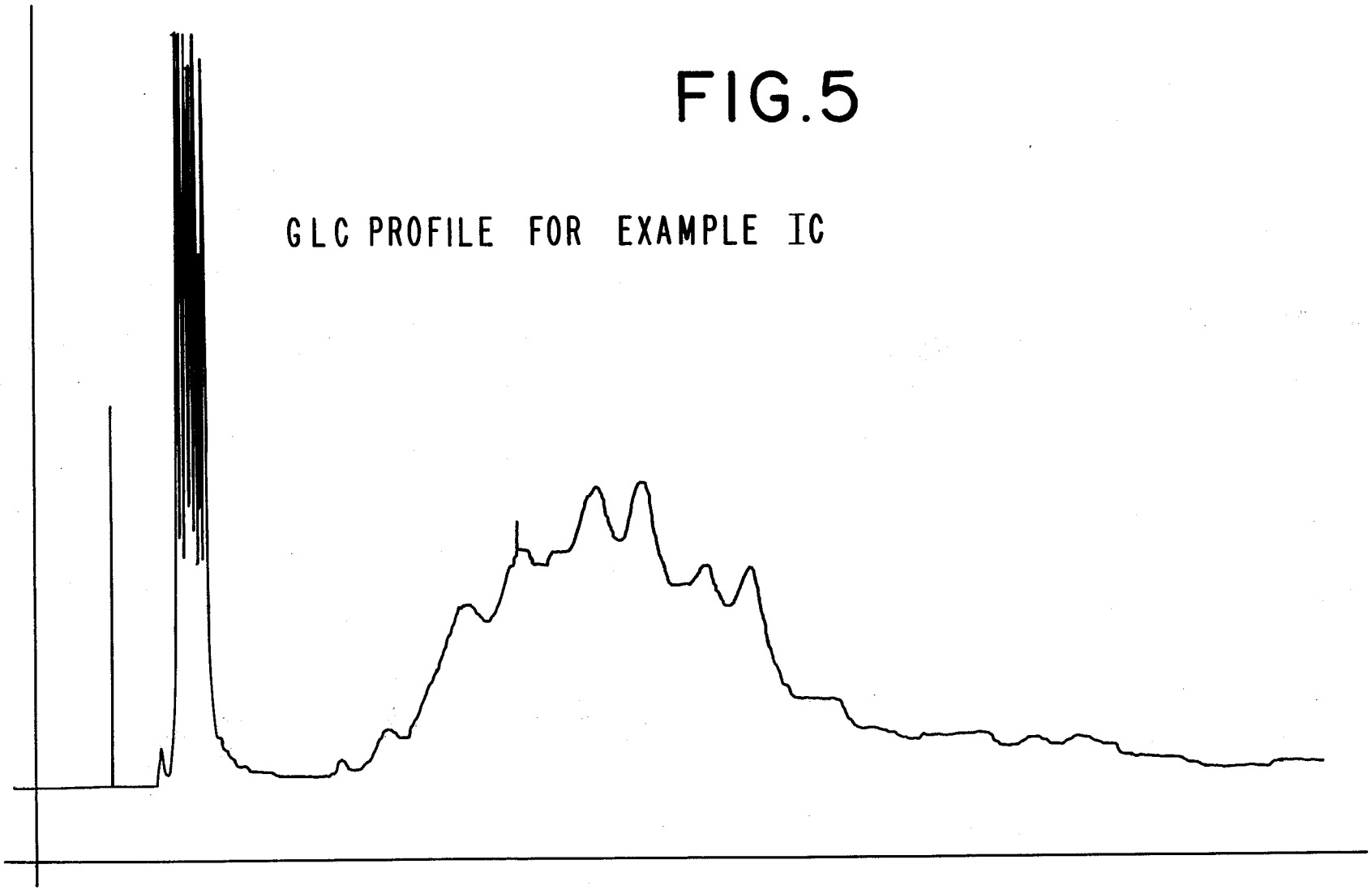
FIG. 5 is the GLC profile for the product produced according to Example I (C), the dimerization product of limonene.
Figure 6:
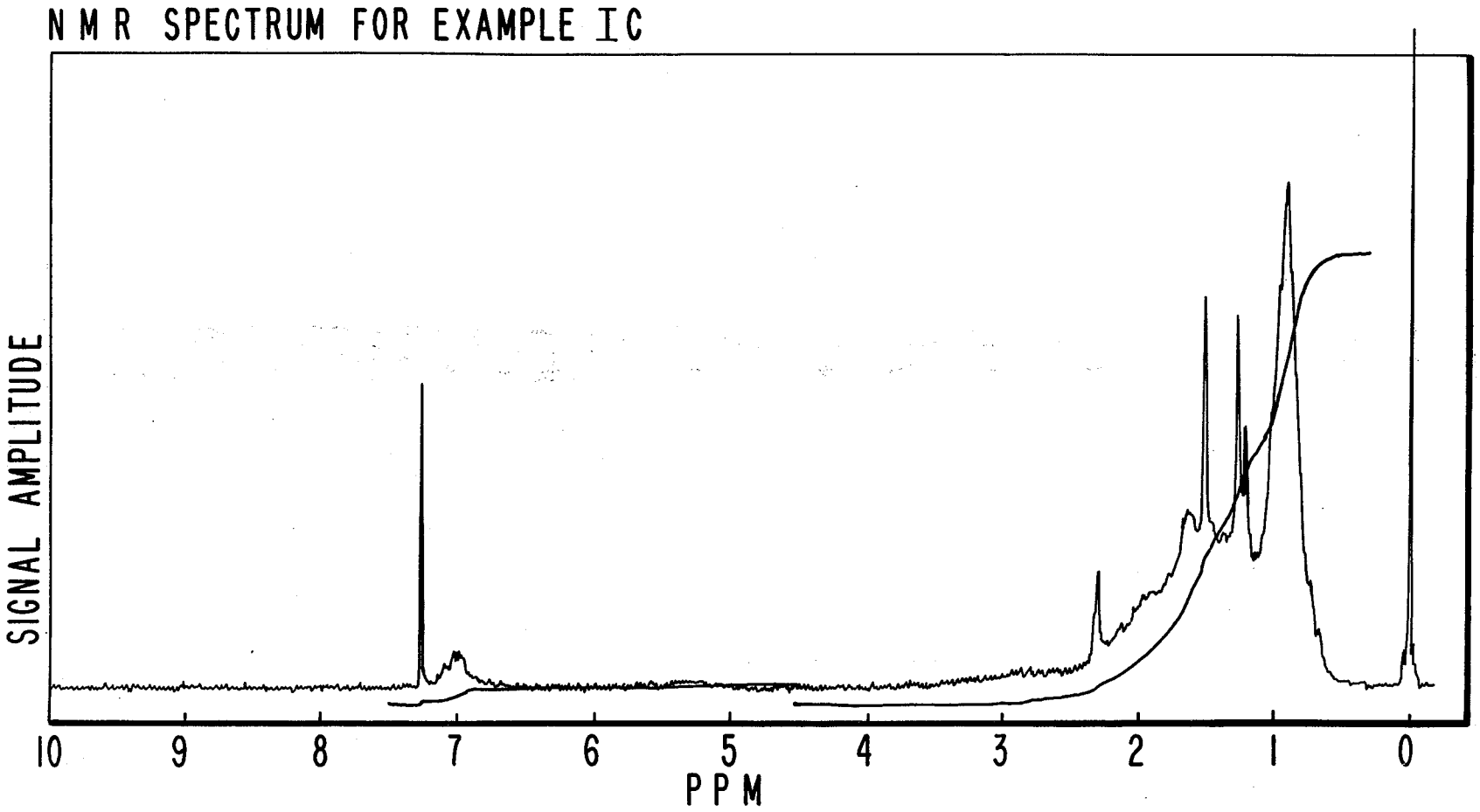
FIG. 6 is the NMR spectrum for the product produced according to Example I (C), the dimer of limonene.
Figure 7:
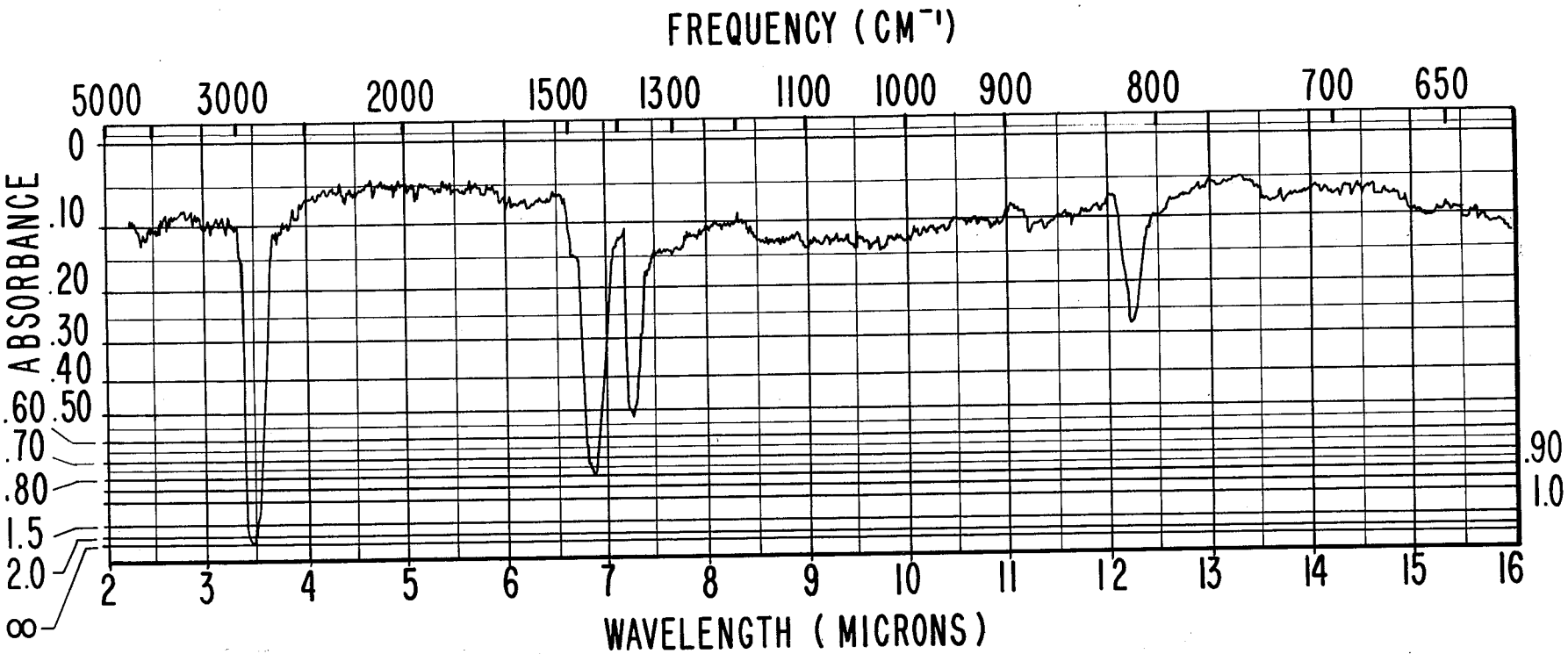
FIG. 7 is the infrared spectrum for the product produced according to Example I (C), the dimer of d-limonene.

The GLC profile is set forth in FIG. 5. The NMR spectrum is set forth in FIG. 6. The IR spectrum is set forth in FIG. 7.

EXAMPLE II

Patchouli oil (80 parts) obtained from the Seychelle Islands is blended with the alpha pinene dimer produced according to Example I (A) (20 parts). The alpha pinene dimer is found to act as an extender for the patchouli oil in that the characteristic odor effect of the latter is substantially not modified.

EXAMPLE III

The extended patchouli oil prepared according to Example II is successfully incorporated into a compounded composition of the Chypre type by blending the following ingredients:

| | Parts |
|---|---|
| Cinnamic Aldehyde | 1 |
| Ethyl Methyl Phenyl Glycidate | 1 |
| Methyl Nonyl Acetaldehyde | 2 |
| Oakmoss (Absolute) | 20 |
| Sandalwood Oil (East Indian) | 20 |
| Vetiveryl Acetate | 20 |
| Ylang Oil No. 1 | 20 |
| Benzoin Resoin (Sumatra) | 30 |
| Alpha Ionone (100%) | 30 |
| Clove Stem Oil (Zanzibar) | 36 |
| Bergamot Oil | 40 |
| Hydroxycitronellal | 40 |
| Iso Eugenol | 40 |
| Extended Patchouli Oil (Example II) | 40 |
| Coumarin | 50 |
| Musk Ketone | 50 |
| Amyl Salicylate | 60 |
| Cedarwood Oil (American) | 60 |
| Citronellol | 60 |
| Benzyl Acetate | 80 |
| Phenyl Ethyl Alcohol | 150 |
| Terpinyl Acetate | 150 |
| | 1000 |

EXAMPLE IV

A patchouli oil extender base is prepared by blending the following ingredients:

| | Parts |
|---|---|
| Alpha Pinene Dimer produced according to Example I (A) | 38 |
| Guaioxide | 27 |
| Isolongifolene Oxidate | 20 |
| Omega-hydroxymethyl longifolene | 10 |
| Cedrol | 3 |
| Sandalwood Oil (East Indian) | 2 |
| | 100 |

This mixture (46 parts) is then blended with natural patchouli oil (Seychelles) (60 parts) to provide a satisfactory extended patchouli oil.

EXAMPLE V

The extended patchouli oil prepared in Example IV is incorporated into a compounded perfumery composition of the Fougere type containing the following ingredients:

| | Parts |
|---|---|
| Balsam Peru | 30 |
| Labdanum Resin | 30 |
| Oakmoss Absolute | 30 |
| Sandalwood Oil (East Indian) | 30 |
| Linalyl Acetate | 40 |
| Terpinyl Acetate | 40 |
| Geranium Oil (Bourbon) | 50 |
| Musk Ambrette | 50 |
| Coumarin | 60 |
| Amyl Salicylate | 60 |
| Methyl Ionone | 70 |
| Cedarwood Oil (American) | 80 |
| Clove Stem Oil (Zanzibar) | 80 |
| Vetivert Oil (Bourbon) | 80 |
| Extended Patchouli Oil | 130 |
| Lavandin Oil | 140 |
| | 1000 |

EXAMPLE VI

Patchouli oil (85 parts) obtained from the Seychelle Islands is blended with the camphene dimer produced according to Example I (B) (15 parts). The camphene dimer is found to act as an extender for the patchouli oil in that the characteristic odor effect of the latter is substantially not modified.

EXAMPLE VII

The extended patchouli oil prepared according to Example VI is successfully incorporated into a compounded composition of the Chypre type by blending the following ingredients:

| | Parts |
|---|---|
| Cinnamic Aldehyde | 1 |
| Ethyl Methyl Phenyl Glycidate | 1 |
| Methyl Nonyl Acetaldehyde | 2 |
| Oakmoss (Absolute) | 20 |
| Sandalwood Oil (East Indian) | 20 |
| Vetiveryl Acetate | 20 |
| Ylang Oil No. 1 | 20 |
| Benzoin Resin (Sumatra) | 30 |
| Alpha Ionone (100%) | 30 |
| Clove Stem Oil (Zanzibar) | 36 |

-continued

| | Parts |
|---|---|
| Bergamot Oil | 40 |
| Hydroxycitronellal | 40 |
| Iso Eugenol | 40 |
| Extended Patchouli Oil (Example II) | 40 |
| Coumarin | 50 |
| Musk Ketone | 50 |
| Amyl Salicylate | 60 |
| Cedarwood Oil (American) | 60 |
| Citronellol | 60 |
| Benzyl Acetate | 80 |
| Phenyl Ethyl Alcohol | 150 |
| Terpinyl Acetate | 150 |
| | 1000 |

EXAMPLE VIII

A patchouli oil extender base is prepared by blending the following ingredients:

| | Parts |
|---|---|
| Camphene Dimer produced according to Example I (B) | 38 |
| Guaioxide | 27 |
| Isolongifolene Oxidate | 20 |
| Omega-hydroxymethyl longifolene | 10 |
| Cedrol | 3 |
| Sandalwood Oil (East Indian) | 2 |
| | 100 |

This mixture (46 parts) is then blended with natural patchouli oil (Seychelles) (60 parts) to provide a satisfactory extended patchouli oil.

EXAMPLE IX

The extended patchouli oil prepared according to Example VIII is incorporated into a compounded perfumery composition of the Fougere type containing the following ingredients:

| | Parts |
|---|---|
| Balsam Peru | 30 |
| Labdanum Resin | 30 |
| Oakmoss Absolute | 30 |
| Sandalwood Oil (East Indian) | 30 |
| Linalyl Acetate | 40 |
| Terpinyl Acetate | 40 |
| Geranium Oil (Bourbon) | 50 |
| Musk Ambrette | 50 |
| Coumarin | 60 |
| Amyl Salicylate | 60 |
| Methyl Ionone | 70 |
| Cedarwood Oil (American) | 80 |
| Clove Stem Oil (Zanzibar) | 80 |
| Vetivert Oil (Bourbon) | 80 |
| Extended Patchouli Oil | 130 |
| Lavandin Oil | 14 |
| | 1000 |

EXAMPLE X

Patchouli oil (85 parts) obtained from the Seychelle Islands is blended with the d-limonene dimer produced according to Example I(C) (15 parts). The d-limonene dimer is found to act as an extender for the patchouli oil in that the characteristic odor effect of the latter is substantially not modified.

EXAMPLE XI

The extended patchouli oil prepared according to Example X is successfully incorporated into a compounded composition of the Chypre type by blending the following ingredients:

| | Parts |
|---|---|
| Cinnamic Aldehyde | 1 |
| Ethyl Methyl Phenyl Glycidate | 1 |
| Methyl Nonyl Acetaldehyde | 2 |
| Oakmoss (Absolute) | 20 |
| Sandalwood Oil (East Indian) | 20 |
| Vetiveryl Acetate | 20 |
| Ylang Oil No. 1 | 20 |
| Benzoin Resoin (Sumatra) | 30 |
| Alpha Ionone (100%) | 30 |
| Clove Stem Oil (Zanzibar) | 36 |
| Bergamot Oil | 40 |
| Hydroxycitronellal | 40 |
| Iso Eugenol | 40 |
| Extended Patchouli Oil (Example II) | 40 |
| Coumarin | 50 |
| Musk Ketone | 50 |
| Amyl Salicylate | 60 |
| Cedarwood Oil (American) | 60 |
| Citronellol | 60 |
| Benzyl Acetate | 80 |
| Phenyl Ethyl Alcohol | 150 |
| Terpinyl Acetate | 150 |
| | 1000 |

EXAMPLE XII

A patchouli oil extender base is prepared by blending the following ingredients:

| | Parts |
|---|---|
| d-Limonene Dimer produced according to Example I (C) | 38 |
| Guaioxide | 27 |
| Isolongifolene Oxidate | 20 |
| Omega-hydroxymethyl longifolene | 10 |
| Cedrol | 3 |
| Sandalwood Oil (East Indian) | 2 |
| | 100 |

This mixture (46 parts) is then blended with natural patchouli oil (Seychelles) (60 parts) to provide a satisfactory extended patchouli oil.

EXAMPLE XIII

The extended patchouli oil prepared according to Example VIII is incorporated into a compounded perfumery composition of the Fougere type containing the following ingredients:

| | Parts |
|---|---|
| Balsam Peru | 30 |
| Labdanum Resin | 30 |
| Oakmoss Absolute | 30 |
| Sandalwood Oil (East Indian) | 30 |
| Linalyl Acetate | 40 |
| Terpinyl Acetate | 40 |
| Geranium Oil (Bourbon) | 50 |
| Musk Ambrette | 50 |
| Coumarin | 60 |
| Amyl Salicylate | 60 |
| Methyl Ionone | 70 |
| Cedarwood Oil (American) | 80 |
| Clove Stem Oil (Zanzibar) | 80 |

-continued

| | Parts |
|---|---|
| Vetivert Oil (Bourbon) | 80 |
| Extended Patchouli Oil | 130 |
| Lavandin Oil | 140 |
| | 1000 |

EXAMPLE XIV

PREPARATION OF DIMERIZATION PRODUCTS FROM SULFATE TURPENTINE

Into a 500 ml reaction flask equipped with thermometer, stirrer, condenser and addition funnel are placed 5 g Primol® and 2 g of a 20% phosphoric acid on silica catalyst produced by the Chemtron Corporation. The reaction mass is heated to 150° C. and 50 g of sulfate turpentine is added dropwise over a period of 2 hours with stirring. The reaction mass is then heated for another 2 hours at 150° C.

The reaction mass is then cooled and filtered and the resulting dimerization product is a mixture of compounds containing unreacted terpene monomers. The unreacted terpene monomers are distilled and again dimerized using a borontrifluoride etherate catalyst. The resulting dimerization products are then combined and distilled and used in the following examples.

EXAMPLE XV

Vetiver Oil (70 parts) obtained from Haiti is blended with the dimerization product produced according to Example XIV. The thus formed dimerization product is found to act as an extender for the vetiver oil in that the characteristic odor effect of the latter is substantially not modified.

EXAMPLE XVI

Sandalwood oil (75 parts) obtained from Indonesia is blended with the dimerization product produced according to Example XIV (25 parts). The dimerization product thus produced is found to act as an extender for the sandalwood oil and that the characteristic odor effect of the latter is substantially not modified.

What is claimed is:

1. A compounded single phase liquid perfumery composition which consists essentially of a perfumery product which is a natural perfume oil or a synthetic perfume oil or a synthetic perfume chemical or a mixture of two or more natural perfume oils or a mixture of two or more synthetic perfume oils or a mixture of two or more perfume chemicals or a mixture of one or more natural perfume oils, synthetic perfume oils and perfume chemicals with which there is intimately admixed a reaction product selected from the group consisting of:

Dimerization products of alpha-pinene;
Dimerization products of beta-pinene;
Dimerization products of camphene;
Dimerization products of d-limonene;
Dimerization products of turpentine;
Hydrogenated dimerization products of alpha-pinene;
Hydrogenated dimerization products of beta-pinene;
Hydrogenated dimerization products of camphene;
Hydrogenated dimerization products of d-limonene;
Hydrogenated dimerization products of turpentine;
Mixtures of said dimerization products and mixtures of said hydrogenated dimerization products, said reaction product being present in a concentration of from about 1 up to about 30 parts per weight per 100 parts by weight of said compounded single phase liquid perfumery composition, and said perfumery product being present in a concentration of from about 70 up to about 99 parts by weight per 100 parts by weight of said compounded single phase liquid perfumery composition.

2. The compounded single phase liquid perfumery composition of claim 1 wherein the reaction product is a dimerization product and said dimerization product is the dimerization product of alpha-pinene.

3. The compounded single phase liquid perfumery composition of claim 1 wherein the reaction product is a dimerization product and the dimerization product is the dimerization product of camphene.

4. The compounded single phase liquid perfumery composition of claim 1 wherein the reaction product is a dimerization product and the dimerization product is the dimerization product of d-limonene.

5. The compounded single phase liquid perfumery composition of claim 1 wherein the reaction product is a dimerization product and the dimerization product is the dimerization product of turpentine.

6. A process for extending a perfumery product selected from the group consisting of natural perfumery oils, synthetic perfumery oils, synthetic perfumery chemicals, mixtures of natural perfumery oils and synthetic perfumery oils, mixtures of natural perfumery oils, synthetic perfumery oils and perfumery chemicals and mixtures of synthetic perfumery oils and synthetic perfumery chemicals without substantially altering the aroma thereof which comprises intimately admixing from about 1 up to about 30 parts by weight of a reaction product selected from the group consisting of:

Dimerization products of alpha-pinene;
Dimerization products of beta-pinene;
Dimerization products of camphene;
Dimerization products of d-limonene;
Dimerization products of turpentine;
Hydrogenated dimerization products of alpha-pinene;
Hydrogenated dimerization products of beta-pinene;
Hydrogenated dimerization products of camphene;
Hydrogenated dimerization products of d-limonene;
Hydrogenated dimerization products of turpentine;
Mixtures of said dimerization products and mixtures of said hydrogenated dimerization products, with from 70 up to 99 parts by weight of said perfumery product.

7. The process of claim 6 wherein the reaction product is a dimerization product and the dimerization product is the dimerization product of camphene.

8. The process of claim 6 wherein the reaction product is a dimerization product and the dimerization product is a dimerization product of alpha-pinene.

9. The process of claim 6 wherein the reaction product is a dimerization product and the dimerization product is a dimerization product of d-limonene.

10. The process of claim 6 wherein the reaction product is a dimerization product and the dimerization product is a dimerization product of turpentine.

* * * * *